US009871320B2

(12) United States Patent
Tezgurler

(10) Patent No.: US 9,871,320 B2
(45) Date of Patent: Jan. 16, 2018

(54) CONNECTOR AND CORRESPONDING CONNECTOR ASSEMBLY

(71) Applicant: NICOMATIC, Bons en Chablais (FR)

(72) Inventor: Hakan Tezgurler, Bons en Chablais (FR)

(73) Assignee: NICOMATIC, Bons en Chablais (FR)

( * ) Notice: Subject to any disclaimer, the term of this patent is extended or adjusted under 35 U.S.C. 154(b) by 0 days.

(21) Appl. No.: 15/116,143

(22) PCT Filed: Jan. 26, 2015

(86) PCT No.: PCT/EP2015/051486

§ 371 (c)(1),
(2) Date: Aug. 2, 2016

(87) PCT Pub. No.: WO2015/113934

PCT Pub. Date: Aug. 6, 2015

(65) Prior Publication Data

US 2017/0170600 A1 Jun. 15, 2017

(30) Foreign Application Priority Data

Feb. 3, 2014 (FR) ..... 14 50808

(51) Int. Cl.
*H01R 13/62* (2006.01)
*H01R 13/627* (2006.01)
*H01R 13/635* (2006.01)

(52) U.S. Cl.
CPC ..... *H01R 13/6275* (2013.01); *H01R 13/635* (2013.01)

(58) Field of Classification Search
CPC . H01R 13/6275; H01R 13/635; H01R 13/629
(Continued)

(56) References Cited

U.S. PATENT DOCUMENTS 5,577,922 A 11/1996 Enomoto et al.
5,741,150 A * 4/1998 Stinson ..... H01R 13/6275 439/157

(Continued)

FOREIGN PATENT DOCUMENTS

| | | |
|---|---|---|
| EP | 1 453 148 A2 | 9/2004 |
| GB | 2 288 924 A | 11/1995 |
| JP | 58-53491 U | 4/1983 |

OTHER PUBLICATIONS

International Search Report dated Apr. 21, 2015 in PCT/EP15/051486 Filed Jan. 26, 2015.

(Continued)

*Primary Examiner* — Abdullah Riyami
*Assistant Examiner* — Nader Alhawamdeh
(74) *Attorney, Agent, or Firm* — Oblon, McClelland, Maier & Neustadt, L.L.P.

(57) ABSTRACT

The application relates to a connector that is connectable to a complementary connector on a plugging-in axis to produce an electrical connection. In particular, the connector includes an actuation device mounted to move on said connector between a connection position and a disconnection position, the actuation device comprising a first part configured to cooperate with the complementary connector to fix the connector to the complementary connector in the connection position, and an ejection device translationally mobile along the plugging-in axis into a position protruding toward the complementary connector, the actuation device comprising a second part configured to cooperate in the disconnection position with the ejection device to drive the translational displacement of the ejection device into the protruding position. Further, the actuation device and the ejection device are formed by at least two distinct elements of the connector.

14 Claims, 7 Drawing Sheets

(58) Field of Classification Search
USPC ..... 439/153
See application file for complete search history.

(56) References Cited

U.S. PATENT DOCUMENTS

| | | | | |
|---|---|---|---|---|
| 5,993,227 | A * | 11/1999 | Hsia | H05K 5/0295 439/159 |
| 7,405,929 | B1 | 7/2008 | Chuang et al. | |
| 2004/0166711 | A1 | 8/2004 | Uchida | |
| 2005/0106912 | A1 | 5/2005 | Hsu | |
| 2010/0323544 | A1 | 12/2010 | Kudo | |

OTHER PUBLICATIONS

French Search Report dated Sep. 23, 2014 in French Application No. 1450808 Filed Feb. 3, 2014.
Office Action dated Sep. 5, 2017 in European Patent Application No. 15 704 472.8.

* cited by examiner

Fig.1
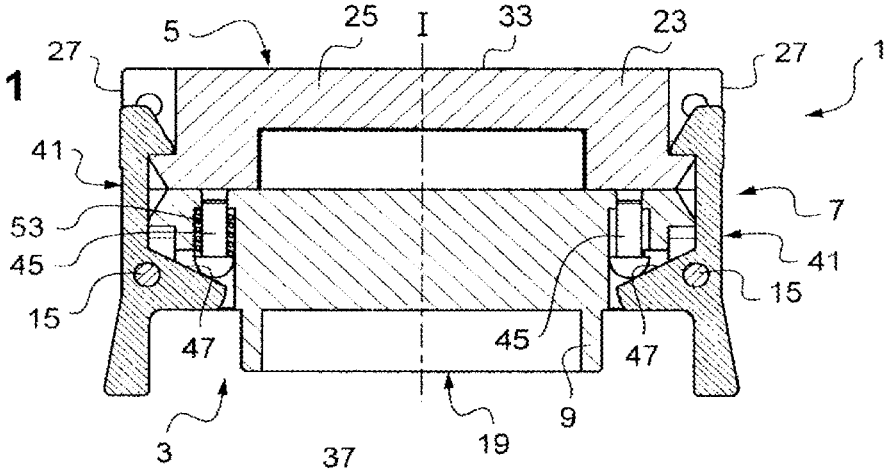
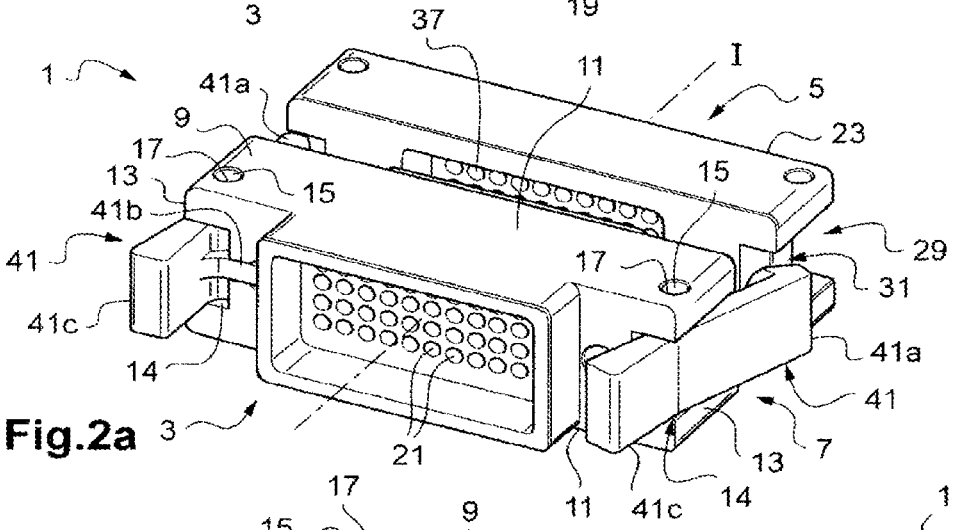
Fig.2a
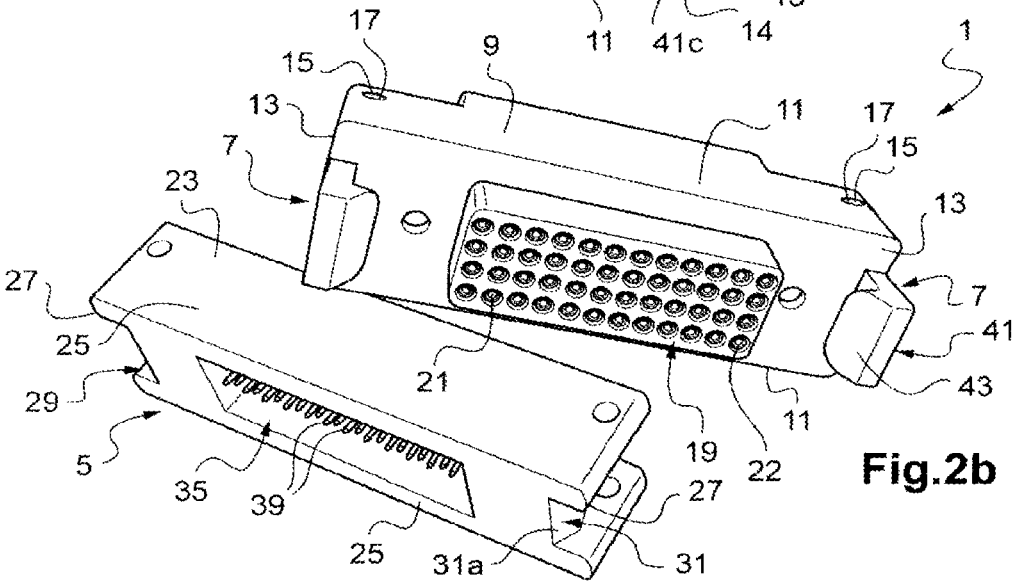
Fig.2b

Fig.4
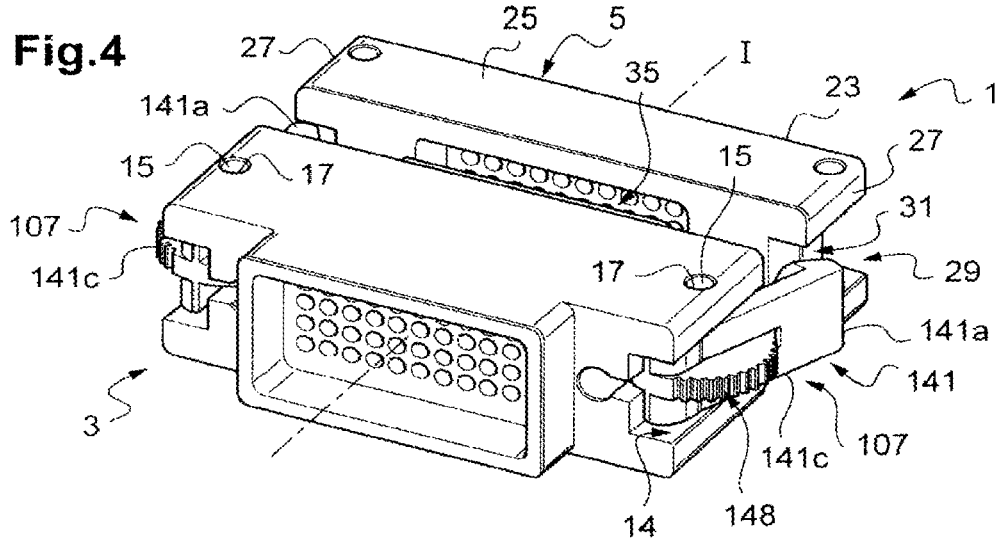
Fig.5a
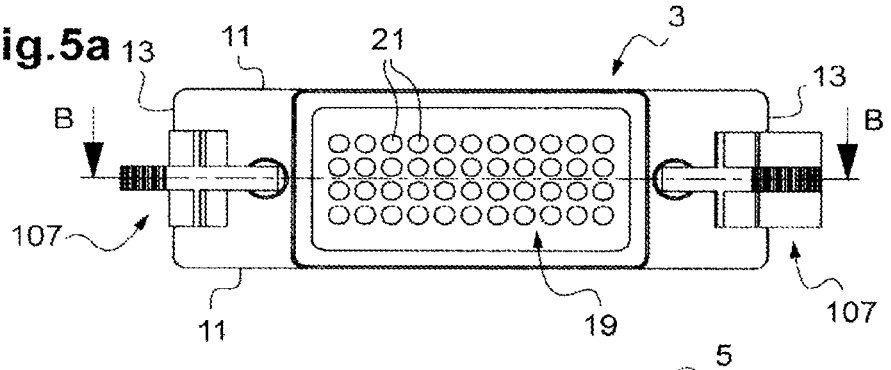
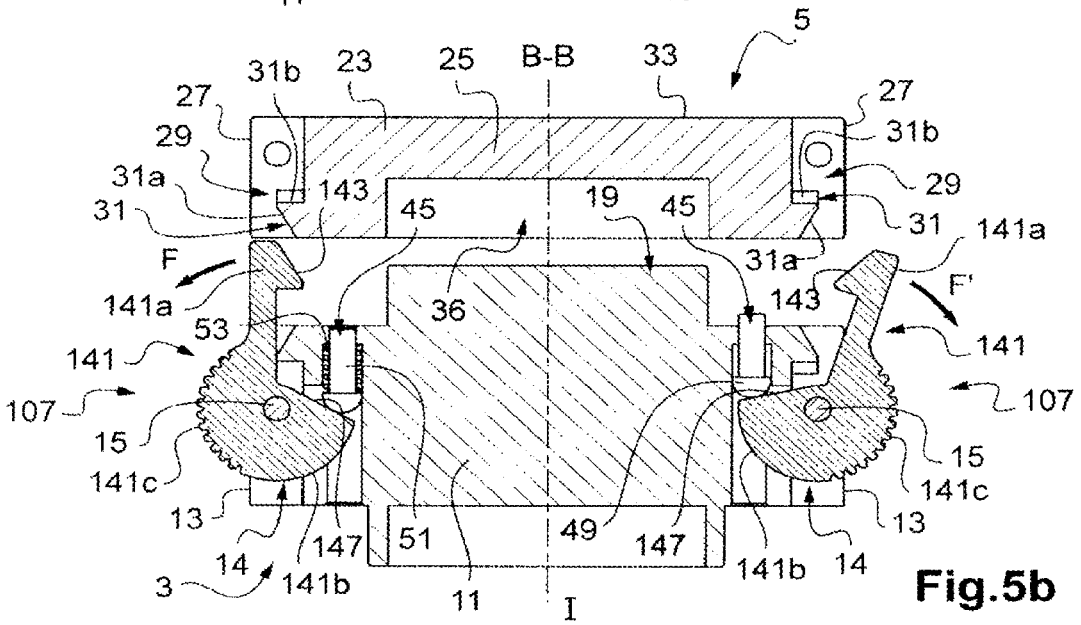
Fig.5b 241a
243
244
53
45
207
241
246
241c
255
241b 15
9
I
17
3
13
207
241a
1
22
241a
15
17
241c
23
243
27
25
241
19
207
5
11
14
13
243
25
27
33

1
I
229
241a
23
25
5
229
27
27
231b
241a
231b
45
19
45
231a
231a
243
243
241
36
241
207
53
255
207
241c
241c
14
13
247
241b
49
241b
13
14
247
3
11

1
I
5
229
45
23
25
19
45
241a
241a
27
243
243
231b
241
231a
36
241
231a
207
53
247
255
207
241c
241c
255
14
13
49
241b
241b
13
14
247
3
11

CONNECTOR AND CORRESPONDING CONNECTOR ASSEMBLY

BACKGROUND

The invention relates to a connector comprising a mechanism for connecting to and disconnecting from a complementary connector. The invention relates also to a connector assembly comprising such a connector.

Such a connector can be used, for example, for military, aeronautical or aerospace applications, or even medical applications.

Generally, a connector assembly comprising two complementary connectors, namely a male connector and a female connector, is commonly used for a removable electrical connection to an electrical circuit, such as a printed circuit.

Typically, the male connector comprises a plurality of connection spindles arranged in one or more rows. The female connector, for its part, comprises female electrical contacts capable of receiving the male connection spindles and connected to electrical conductors to establish an electrical contact.

Because of the friction forces that exist between the female contacts and the male connection spindles, in order to assist a user in separating the two female and male connectors, it is known practice to provide an ejection mechanism movably mounted on one of the connectors.

According to one known solution, the disconnection mechanism comprises two ejection levers that can be actuated manually, and mounted on the end lateral walls of one of the connectors, such as the male connector.

Such a lever is, for example, formed substantially in an "L" shape. The lever has a first extension protruding from the shell of the connector bearing the disconnection mechanism, such as the male connector, in the rest position, that is to say when the two complementary connectors are connected. The lever has a second extension forming a lever foot and extending into a cavity of the male connector comprising the connection spindles.

When a lever is actuated manually by a rotational movement, the lever foot pushes on the complementary connector, such as the female connector, this complementary connector then being displaced vertically by the foot of the ejector-forming lever in order to separate the female connector from the male connector.

According to this solution, the travel of the lever is limited by a stop on an internal wall of the connector, such as the male connector, bearing the ejection levers.

However, with such a solution, the movement of the lever foot pushing on the complementary connector is rotational, such that the force applied to the complementary connector tilts during the actuation of the lever. The disconnection with such a tilted force cannot be accurate in the plug-in zones of the electrical contacts.

Furthermore, such a disconnection mechanism is not designed to lock the connection between the two connectors in the connection position.

Furthermore, according to this known solution, when the two connectors are coupled, the actuation levers occupy a not-inconsiderable space behind the shell of the connector bearing the ejection mechanism. This bulk of the connector bearing the ejection mechanism does not therefore allow, if the latter is mounted on an electrical circuit board, for the arrangement of other electrical and/or electronic components, such as resistors for example, in this space occupied by the actuation levers.

BRIEF SUMMARY

The aim of the invention is therefore to at least partially mitigate the drawbacks of the prior art, by proposing an alternative connector bearing a mechanism which is ergonomic and allows for both:

- a reliable and simple connection between the two connectors, and
- a quick and simple disconnection, without damaging the complementary electrical contacts.

To this end, the subject of the invention is a connector that can be connected with a complementary connector on a plugging-in axis to produce an electrical connection, characterized in that it comprises a mechanism for connecting to and disconnecting from the complementary connector comprising:

- at least one actuation device mounted to move on said connector between a connection position and a disconnection position, the actuation device comprising at least one first part configured to cooperate with the complementary connector to fix the connector to the complementary connector in the connection position, and
- at least one ejection device translationally mobile along the plugging-in axis into a position protruding toward the complementary connector, the actuation device comprising at least one second part configured to cooperate in the disconnection position with the ejection device to drive the translational displacement of the ejection device into the protruding position,
- the actuation device and the ejection device being formed by at least two distinct elements of the connector.

The mechanism borne by one of the connectors is thus able to be engaged in the complementary connector to lock the mechanical connection between the two connectors so as to secure the electrical connection between the two connectors. The mechanical engagement of the mechanism to the complementary connector works by a simple and natural movement while guaranteeing a reliable connection.

Furthermore, the ejection device makes it possible to push the complementary connector in the direction of plugging-in of the connection spindles borne by one of the connectors into the corresponding electrical contacts borne by the other connector. This makes it possible to avoid damaging the electrical contacts by forcing the connectors in order to separate them. It will therefore be understood that the disconnection works in the alignment of the electrical contacts, notably of the electrical connection spindles, thus avoiding damaging these spindles.

It is thus possible to use parts of simple form, such as pieces or plungers to produce the ejection function. Such pieces can further be easily mounted inside said connector so as to be driven translationally by an associated actuation device.

Thus, a mechanism is produced simply that applies a force always in the plugging-in axis to allow for an accurate disconnection in the plug-in zones of the two connectors.

Said connector can further comprise one or more of the following features, taken separately or in combination:

- the actuation device is pivotably mounted;
- an actuation device is fixed to said connector using an axis arranged in such a way as to pass transversely through said connector and the actuation device, and the actuation device is mounted pivotably mobile about said axis;

the actuation device is mounted to be translationally mobile substantially transversely to the plugging-in axis;

the ejection device is mounted on said connector between a position retracted inside said connector and a position protruding from said connector toward the complementary connector.

According to a preferred embodiment, the connection and disconnection mechanism comprises two actuation devices and two ejection devices respectively associated with an actuation device.

Said connector can extend longitudinally through a first and a second end lateral walls and the two actuation devices are for example arranged on the two longitudinally opposing end lateral walls of said connector.

The connector thus allows for an ergonomic control that is simple to use, and that makes it possible to connect and disconnect in a balanced manner, with no specific tool and in a blind manner.

Said connector can further comprise one or more of the following features, taken separately or in combination:

said connector extends substantially transversely to the plugging-in axis;

the first part of an actuation device has a means for securing to the complementary connector, for example produced in the form of a hook;

the second part has a contact surface inclined relative to the plugging-in axis;

an actuation device is produced in the form of an actuation lever comprising a first part and a second part having a substantially "L" shaped form;

an actuation device comprises a gripping part accessible from outside said connector;

the gripping part is arranged at the end of the actuation device opposite the end configured to cooperate with the complementary connector;

an actuation device comprises a thumbwheel having a gripping part accessible from outside said connector and a part formed inside said connector to cooperate with an associated ejection device;

said connector is a female connector capable of receiving corresponding connection spindles of a complementary male connector.

The invention also relates to a connector assembly comprising a female connector and a male connector complementing the female connector, characterized in that at least one of the connectors is as defined previously. According to a preferred embodiment, it is the female connector.

According to one aspect of the invention, the connector complementing the connector bearing the connection and disconnection mechanism has at least one housing configured to engage with and secure at least one element of the connection and disconnection mechanism.

According to an exemplary embodiment, the two connectors extend longitudinally and the housing is produced by a recess of the longitudinally opposing end walls of the connector complementing the connector bearing said mechanism.

As an alternative, the housing is produced inside the connector complementing the connector bearing said mechanism.

The complementary connector can comprise a first securing means having a slope and a bearing portion capable of cooperating with a complementary second securing means borne by the connection and disconnection mechanism.

BRIEF DESCRIPTION OF THE DRAWINGS

Other features and advantages of the invention will emerge from the following description, given as a nonlimiting example, in light of the attached drawings in which:

FIG. 1 illustrates a connector assembly comprising a female connector and a male connector which are complementary and assembled together, and a mechanism for connecting and disconnecting the two connectors according to a first embodiment, FIG. 2*a* is a perspective view of the disconnected male and female connectors of the connector assembly of FIG. 1, in which an actuation device of the connection and disconnection mechanism has been pivotably driven, FIG. 2*b* represents the male and female connectors of the connector assembly of FIG. 1 provided with electrical contacts, FIG. 4 is a perspective view of the connector assembly representing the male and female connectors disconnected from one another and a mechanism for connecting and disconnecting the two connectors according to a second embodiment in which an actuation device has been pivotably driven, FIG. 5*a* is an underside view of the female connector of FIG. 4, FIG. 5*b* is a view in cross section along the axis B-B defined in FIG. 5*a*, of the male and female connectors in the disconnected state.

DETAILED DESCRIPTION

Figure 3A:
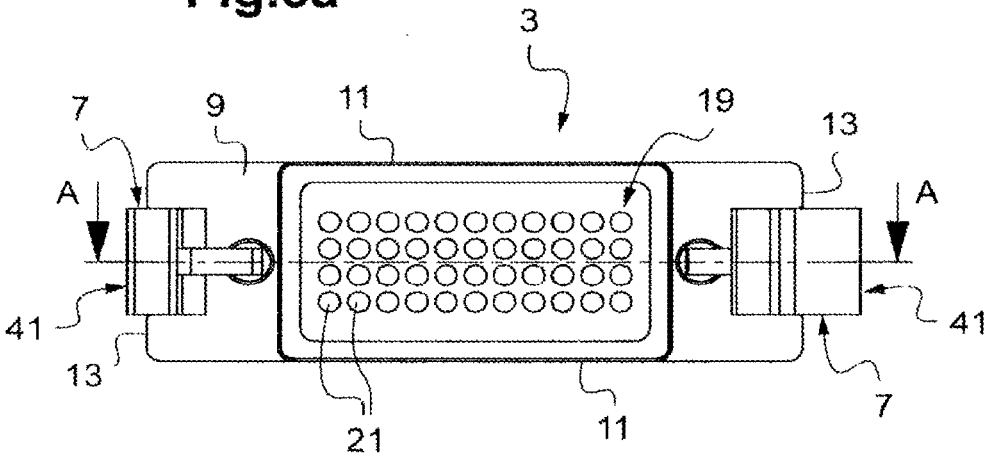
FIG. 3*a* is an underside view of the female connector of FIG. 2*a*.

In these figures, elements that are substantially identical bear the same references.

In FIGS. 4 to 5*b*, the elements corresponding to the elements of FIGS. 1 to 3*b* bear the same references preceded by the hundreds numeral 1. In FIGS. 6*a* to 6*c*, 9*a* and 9*b*, the elements corresponding to the elements of FIGS. 1 to 3*b* bear the same references preceded by the hundreds numeral 2.

FIG. 1, in a simplified manner, represents a connector assembly 1 comprising a female connector 3 and a male connector 5 complementing the female connector 3. They are in particular connectors 3, 5 called flat connectors.

FIG. 2*a* illustrates an exploded view of the connector assembly 1, with the female connector 3 and the complementary male connector 5 in the disassembled state. The two connectors 3, 5 can be connected to one another in a plugging-in direction I to produce an electrical connection. The two connectors 3 and 5 are also capable of being disconnected from one another along the plugging-in axis I.

To this end, the connector assembly 1 further comprises a mechanism 7, 107, 207 for connecting and disconnecting the female connector 3 to and from the male connector 5.

The connection and disconnection mechanism 7, 107 or 207 is described in more detail hereinbelow, with reference to FIGS. 1 to 3*b* for a first embodiment, with reference to FIGS. 4 to 5*b* for a second embodiment, and with reference to FIGS. 6*a* to 6*c* for a third embodiment.

The connection and disconnection mechanism 7, 107 or 207 is mounted on one or other of the connectors 3 or 5. According to the embodiments described herein, the connection and disconnection mechanism 7, 107 or 207 is mounted on the female connector 3.

Moreover, any appropriate means can be provided that makes it possible to prevent undesirable untimely actuation of the connection and disconnection mechanism 7, 107 or 207, such as a cap (not represented) arranged around the connector assembly 1. Obviously, in this case, the cap is advantageously provided with a passage formed to allow a user to easily access the connection and disconnection mechanism 7, 107, 207.

Female Connector

The female connector 3 is described hereinbelow in more detail.

According to the embodiment illustrated, the female connector 3 extends longitudinally substantially transversely to the plugging-in direction I.

Referring to FIGS. 2*a* to 3*b*, the female connector 3 has a shell 9.

According to a preferred embodiment, the shell 9 is produced in a material comprising aluminum or an aluminum alloy, for example nickel-plated aluminum.

The shell 9 has, for example, a substantially parallelepipedal box form with two opposing longitudinal walls 11 and two opposing end lateral walls 13. The end lateral walls 13 are longitudinally opposite.

Figure 7:
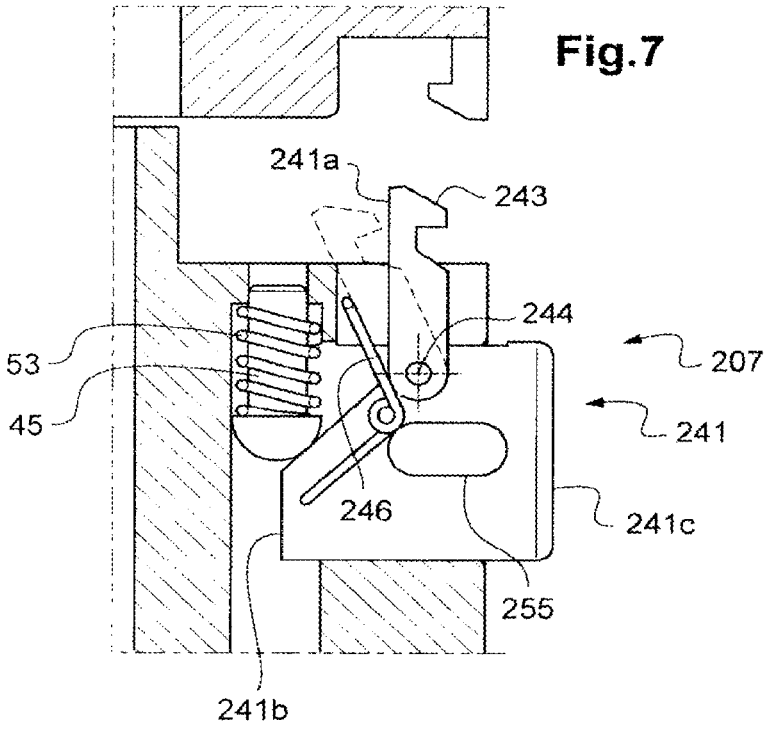
FIG. 7 illustrates a variant embodiment of the connection and disconnection mechanism according to the third embodiment, in which an actuation device is produced in two parts.
Figure 6A:
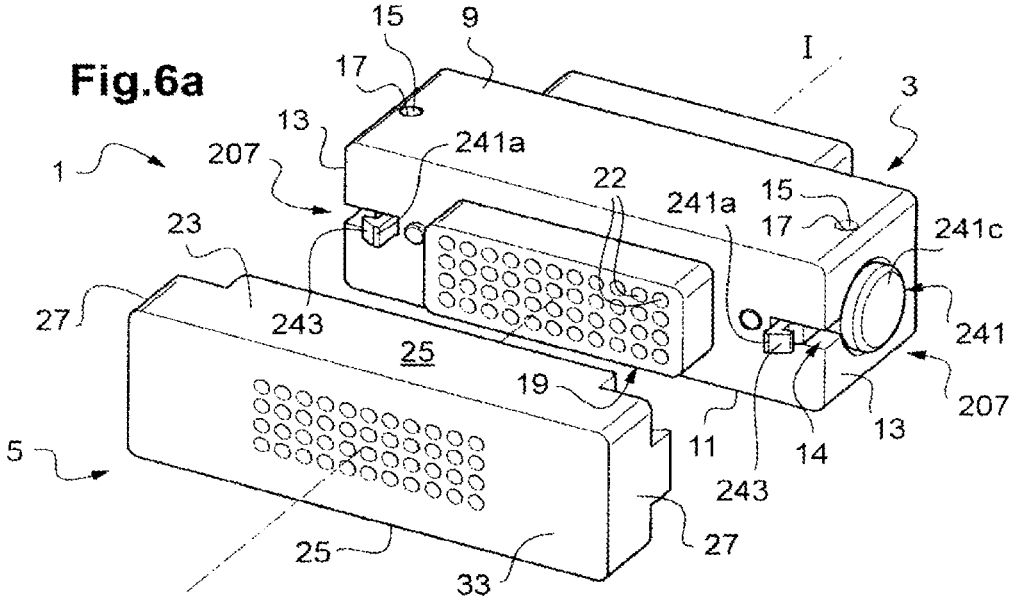
FIG. 6*a* is a perspective view of the connector assembly representing the male and female connectors disconnected from one another and a mechanism for connecting and disconnecting the two connectors according to a third embodiment.

According to the embodiments described, the lateral walls 13 respectively form a support for the connection and disconnection mechanism 7 (FIG. 1 to 3*b*) or 107 (FIG. 4 to 5*b*) or 207 (FIGS. 6*a* to 7). For this, it is possible to provide a recess 14 in each lateral wall 13 to arrange at least one element of the connection and disconnection mechanism 7 (FIG. 2*a*) or 107 (FIG. 4) or 207 (FIGS. 6*a* to 7).

The female connector 3 can also comprise a means 15 for fixing the connection and disconnection mechanism 7 (FIGS. 1 to 2*b*, and 3*b*) or 107 (FIGS. 4 and 5*b*) or even 207 (FIGS. 6*a* to 7).

The fixing means 15 is for example produced using an axis 15 arranged so as to pass through at least one element of the connection and disconnection mechanism 7 (FIG. 1 to 3*b*) or 107 (FIGS. 4 to 5*b*), 207 (FIG. 6*a*) as will be described in more detail hereinbelow. The ends of the axis 15 are received in two complementary holes 17 provided for this purpose on the shell 9 (see FIGS. 2*a* and 4), more specifically in the lateral walls 13.

According to an alternative, provision can be made for the female connector 3 to have an internal guiding means, for example, but in a nonlimiting manner, of dovetail type, and a fixing means such as a pin to secure at least one element of the connection and disconnection mechanism 207 in the female connector 3.

The female connector 3 further comprises a support 19 for electrical contacts. The support 19 for electrical contacts is for example arranged substantially centrally on the longitudinal axis of the female connector 3. The support 19 for electrical contacts extends for example to protrude on either side of the shell 9 of the female connector 3 in the plugging-in direction I as can better be seen in FIGS. 3*b* and 5*b*.

The support 19 for electrical contacts can comprise at least one first orifice 21 or one or more rows of first orifices 21. The support 19 for electrical contacts has, for example, a general substantially parallelepipedal block form, in which the first orifices 21 are formed to receive first electrical contacts 22 that can be seen in FIG. 2*b*. The first electrical contacts 22 are formed to allow the plugging-in of second complementary electrical contacts (described hereinbelow) borne by the male connector 5.

The number of first orifices 21 is chosen according to the number of contacts needed for the desired connection.

Moreover, according to the example illustrated, the first orifices 21 have for example a substantially cylindrical form. The first electrical contacts 22 can have a substantially cylindrical form complementing the cylindrical form of the first orifices 21.

Male Connector

The male connector 5, which can better be seen in FIG. 2*b*, also has a shell 23.

According to a preferred embodiment, the shell 23 is produced in a material comprising aluminum or an aluminum alloy. It can be the same material as the material of the female connector 3, for example nickel-plated aluminum.

The shell 23 forms a male case, of substantially parallelepipedal form, having two opposing longitudinal walls 25 and two opposing lateral walls 27. The end lateral walls 27 are longitudinally opposite.

A housing 29 (FIG. 2*b*, 3*b*, 4, 5*b*) or 229 (FIG. 6*b*) can be provided to at least partially receive at least one element of the connection and disconnection mechanism 7 (FIG. 1 to 3*b*) or 107 (FIG. 4 to 5*b*) or 207 (FIGS. 6*a* to 7), as will be detailed hereinbelow. This housing 29, 229 is also configured for the engagement and securing of at least one element of the connection and disconnection mechanism 7, 107 or 207 or 207.

The housing 29 (FIGS. 2*b*, 3*b*, 4, 5*b*) can be produced by a recess, for example, on the plugging-in axis I on the end lateral walls 27 of the shell 23. As a variant, the housing 229 (FIG. 6*b*) can be produced inside the male connector 5, for example on the plugging-in axis I.

The male connector 5 further has a first securing means 31 or 231 formed to cooperate with the connection and disconnection mechanism 7 (FIGS. 2*b* and 3*b*) or 107 (FIGS. 4 and 5*b*) or 207 (FIGS. 6*a* to 7), in order to secure the connection between the two connectors 3 and 5.

The first securing means 31, 231 has, for this purpose, a slope 31*a*, 231*a* and a bearing portion 31*b*, 231*b*.

The bearing portion 31*b* is for example accessible from the outside of the male connector 5 according to the examples illustrated in FIGS. 2*b*, 3*b*, 4 and 5*b*. As a variant, the bearing portion 231*b* may not be accessible from the outside of the male connector 5 but, on the contrary, is formed inside the male connector 5.

The cooperation between the slope 31*a*, respectively 231*a*, and the bearing portion 31*b*, respectively 231*b*, with at least one element of the connection and disconnection mechanism 7 (FIG. 3*b*) or 107 (FIG. 5*b*) or 207 (FIGS. 6*a* to 7) will be described in more detail hereinbelow.

Figure 3B:
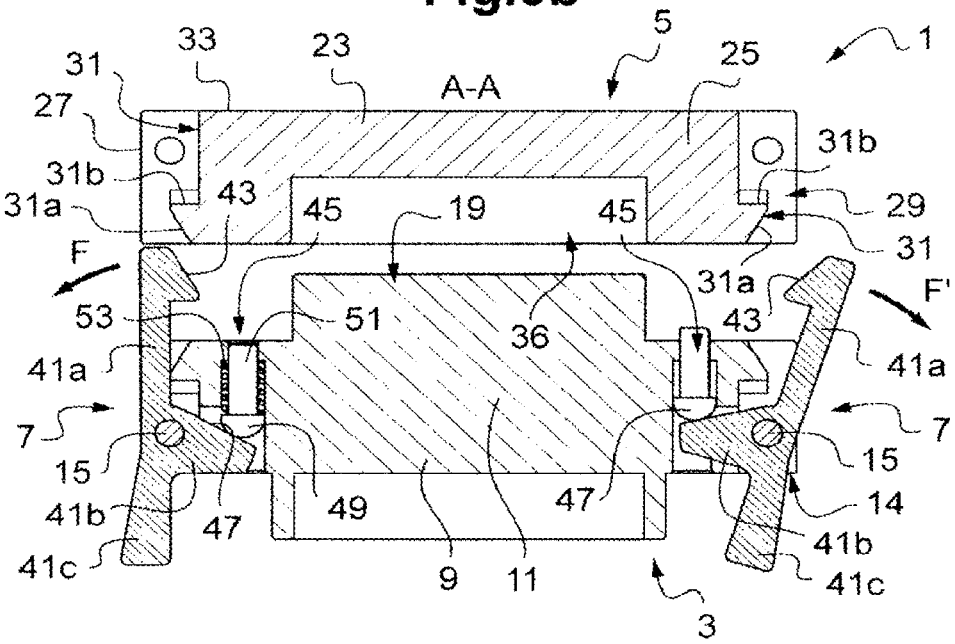
FIG. 3*b* is a view in cross section along the axis A-A defined in FIG. 3*a*, of the male and female connectors in the disconnected state.

As can better be seen in FIG. 3*b* or 5*b*, the male case 5 further comprises a base or bottom wall 33 from which the longitudinal walls 25 and the end lateral walls 27 extend parallel to the plugging-in direction I.

Furthermore, the male connector 5 also comprises a support 35 for electrical contacts (FIGS. 2*a* and 2*b* or 4).

The support 35 for electrical contacts of the male connector 5 is arranged so as to be facing the corresponding support 19 for electrical contacts of the female connector 3 when the two connectors 3, 5 are connected. The support 35 for electrical contacts is, for example, arranged substantially centrally on the longitudinal axis of the male connector 5.

According to the embodiments illustrated, the longitudinal walls 25 and the end lateral walls 27 define between them a cavity 36 (FIG. 3*b* or 5*b* or 6*c*) in which is formed the support 35 for electrical contacts.

The support 35 for electrical contacts comprises at least one orifice 37 provided with a second electrical contact 39 configured to be connected to the complementary female connector 3 via a first orifice 21 and a first electrical contact 22 that are associated with the female connector 3.

The number and the arrangement of the orifices 37, and therefore of the second electrical contacts 39, are dependent on the number and the arrangement of the associated first orifices 21 of the female connector 3. In other words, the male connector 5 has the same number of orifices 37 as the female connector 3 and these orifices 37 are arranged so as to be facing the associated orifices 21 of the female connector 3 when the two connectors 3 and 5 are connected to one another. According to the example illustrated, the male connector 5 comprises several rows of orifices 37 provided with second electrical contacts 39.

According to the example illustrated in FIG. 2*b*, the second electrical contacts 39 of the male connector 5 have connection spindles formed to be plugged into the first electrical contacts 22 in the associated orifices 21 of the female connector 3. The connection spindles have, for example, a generally substantially cylindrical form complementing the cylindrical form of the first orifices 21 of the female connector 3 and the substantially cylindrical form of the first electrical contacts 22.

Connection/Disconnection Mechanism

The connection and disconnection mechanism 7 (FIG. 1 to 3*b*) or 107 (FIG. 4 to 5*b*) or 207 (FIGS. 6*a* to 7) is arranged on one of the connectors described previously, here the female connector 3.

In this case, if the male connector 5 is for example arranged on an electrical circuit board, this male connector 5 which is on the electrical circuit board is not manipulated to actuate the connection and disconnection mechanism 7, 107, 207, but the complementary female connector 3 is so manipulated. The location on the electrical circuit board around the male connector 5 can therefore be left free to connect other electrical and/or electronic components.

The connection and disconnection mechanism 7 (FIG. 1 to 3*b*) or 107 (FIG. 4 to 5*b*) or 207 (FIGS. 6*a* to 7) is arranged more specifically at the end lateral walls 13 of the shell 9 of the associated connector.

The connection and disconnection mechanism 7, 107, 207 comprises:

at least one actuation device 41, 141, 241 mounted to move on said connector 3 between a connection position and a disconnection position, the actuation device 41, 141, 241 comprising at least one first part 41*a*, 141*a*, 241*a* configured to cooperate in the connection position with the complementary connector 5 to fix the connector 3 to the complementary connector 5, notably using a second securing means 43, and at least one ejection device 45 that can move translationally along the plugging-in axis I into a position protruding toward the complementary connector 5, the actuation device comprising at least one second part 41*b*, 141*b*, 241*b* configured to cooperate in the disconnection position with the ejection device 45 to drive the translational displacement of the ejection device 45 into the protruding position, the actuation device and the ejection device 45 being formed by at least two distinct elements of the connector 3.

According to the embodiments illustrated, the connection and disconnection mechanism 7, 107, 207 comprises two actuation devices 41, 141, 241 and two ejection devices 45 respectively associated with an actuation device 41, 141, 241.

More specifically, the connection and disconnection mechanism 7 (FIG. 1 to 3*b*) or 107 (FIGS. 4 to 5*b*) or even 207 (FIGS. 6*a* to 7) comprises:

two actuation devices 41 or 141 or 241 that can respectively move between the position of connection between the two female and male connectors 3, 5 and the position of disconnection of the two connectors 3 and 5, at least one second means 43, 143, 243 for securing the female 3 and male 5 connectors in the assembled state, and two ejection devices 45 respectively capable of being driven in translation along the plugging-in axis I, by a corresponding actuation device 41 or 141 or 241.

Actuation Device

First Embodiment

According to the first embodiment illustrated in FIGS. 1 to 3*b*, the actuation devices 41 are mounted to move pivotably about the axis 15, from one of the lateral walls 13 of the shell 9 of the associated connector, for example of the female connector 3. The axis 15 therefore serves as fixing axis but also as pivoting axis.

More specifically, referring to the orientation of the figures, a first actuation device 41 on the left in FIG. 3*b* is capable of pivoting from the connection position to the disconnection position in a counterclockwise direction schematically represented by the arrow F and a second actuation device 41 on the right in FIG. 3*b* is capable of pivoting in a clockwise direction schematically represented by the arrow F'. The two actuation devices 41 pivot outward from the connector 3 from the connection position to the disconnection position. In FIG. 3*b*, only one of the actuation devices 41 (on the right referring to the orientation of the figures) is illustrated in a position after pivoting to the disconnection position.

The actuation devices 41 are for example produced in the form of two actuation levers 41 mounted on the shell 9 of one of the connectors, here the female connector 3, on the end lateral walls 13 thereof.

The actuation levers 41 can be produced, by way of nonlimiting example, in stainless material.

Referring to FIG. 3*b*, the actuation devices 41 respectively comprise:

at least one first part 41*a* bearing, for example, a second securing means 43 and capable of being received in the complementary connector, such as the male connector 5 in this example, at least one second part 41*b* capable of cooperating with an associated ejection device 45.

The actuation devices 41 advantageously comprise at least one third gripping part 41*c* accessible from the outside of said connector 3.

The three parts 41*a*, 41*b*, 41*c* of an actuation lever 41 are, according to the example illustrated, produced in a single piece.

According to the example illustrated, the first part 41*a* extends longitudinally in a first direction and the second part 41*b* extends in a second direction different from the first direction.

The first part 41*a* extends for example substantially parallel to the lateral wall 13 on which the actuation lever 41 is mounted in the first connection position, the lateral wall 13 extending parallel to the plugging-in axis I in this example, that is to say substantially vertically referring to the orientation of FIG. 1 or 3*b*.

According to the example illustrated, it is the first part 41*a* of an actuation lever 41 which receives the pivoting axis 15.

The first part 41*a* is formed to be received in the complementary connector, such as the male connector 5 in this example. More specifically, the first part 41*a* is received in the recess 29 of an end lateral wall 27 of the complementary connector, here the male connector 5, when the two connectors 3 and 5 are connected to one another.

According to the first embodiment illustrated, the first part 41*a* and the second part 41*b* of the actuation lever 41 have a substantially "L" shaped form. The second part 41*b* extends from the first part 41*a* on the axis 15 to the interior of the shell 9 of the associated connector, of the female connector 3 in the example illustrated. To this end, a lateral wall 13 of the female connector 3 in this example, forming a support for the connection and disconnection mechanism 7, has an opening to receive the second part 41*b* of the actuation lever 41. This opening is for example formed in the lower part of the shell 9, that is to say the part opposite the part facing the complementary connector 5.

Furthermore, the second part 41*b* has a contact surface 47 with an associated ejection device 45. The contact surface 47 is, in the example illustrated, formed by a slope that is inclined relative to the plugging-in axis I. The angle of inclination of the contact surface 47 is chosen in such a way as to drive the ejection device in displacement when the second part 41*b* pivots about the axis 15, until the ejection device 45 protrudes from the plane of the connector 3, so as to push on the facing complementary connector 5 and make it possible to uncouple the two connectors 3 and 5.

The third gripping part 41*c*, for its part, allows for a manual actuation of the actuation lever 41 to uncouple the two connectors 3 and 5.

According to the first embodiment illustrated in FIGS. 2 to 3*b*, the gripping part 41*c* is produced in the form of a longitudinal extension at the end of the first part 41*a* of the actuation lever 41. In this example, the gripping part 41*c* has a varying thickness, the thickness at the end of the gripping part 41*c* being chosen to be sufficient to allow for a good control by a user.

Furthermore, a second securing means 43 (FIG. 3*b*) is for example arranged at the end of the first part 41*a* of each driving means 41.

A second securing means 43 is capable of cooperating with a first complementary securing means 31 provided on the male connector 5 to which the female connector 3 is to be connected.

The securing of the connection between the female and male connectors 3, 5 is done for example by snap-fitting.

Thus, a second securing means is for example produced in the form of a hook 43 formed to cooperate with a first securing means 31 of the complementary connector 5.

To this end, the hook 43 has a form complementing the form of the slope 31*a* and of the bearing portion 31*b*. This allows for the placement and the securing of a part (here the first part 41*a*) of the actuation device 41 in the recess 29 of the male connector 5. In effect, when the female connector 3 is displaced along the plugging-in axis I to be connected to the male connector 5, the hook 43 is able to slide against the slope 31*a* until it goes beyond this slope 31*a* and comes to rest against the bearing portion 31*b*.

The hook 43 is for example formed on the side of the first part 41*a* of the actuation device oriented toward the interior of the female connector 3.

Second Embodiment

According to the second embodiment illustrated in FIGS. 4 to 5*b*, the actuation devices 141 are also mounted to move pivotably about the axis 15, from one of the lateral walls 13 of the shell 9 of the associated connector, for example of the female connector 3.

The actuation device 141 comprises a first part 141*a* comprising a second securing means 143, substantially similar to the first part 41*a* of an actuation lever 41 according to the first embodiment. This first part 141*a* is not therefore described again.

The actuation device 141 according to the second embodiment can further comprise a cam or thumbwheel 141*b*, 141*c* provided at the end of the first part 141*a*. The thumbwheel has:

a part 141*c* which is accessible from the outside of the connector 3 and which forms the gripping part, and a non-accessible part 141*b*, formed inside the connector 3 and which has a contact surface 147 capable of cooperating with an associated ejection device 45.

As previously, an opening is formed in the lateral walls 13 of the connector bearing the connection and disconnection mechanism 107, here the female connector 3, to house the part 141*b* of the thumbwheel inside the female connector 3.

According to the second embodiment, the second 141*b* and third 141*c* parts of the actuation device 141 are therefore formed by the thumbwheel.

As for the first embodiment, the contact surface 147 provided on the thumbwheel forms a slope that is inclined relative to the plugging-in axis I. The angle of inclination of the contact surface 147 is chosen so as to drive the ejection device 45 in displacement when the thumbwheel, actuated manually, pivots about the axis 15, until the ejection device 45 protrudes from the plane of the female connector 3, so as to push on the facing complementary connector 5 and make it possible to uncouple the two connectors 3 and 5.

It is possible to also provide a means to facilitate the control of the gripping means, such as teeth 148 provided on the outer surface of the gripping means 141*c* for example produced in thumbwheel form as illustrated in FIGS. 4 and 5*b*.

Third Embodiment

Figure 6B:
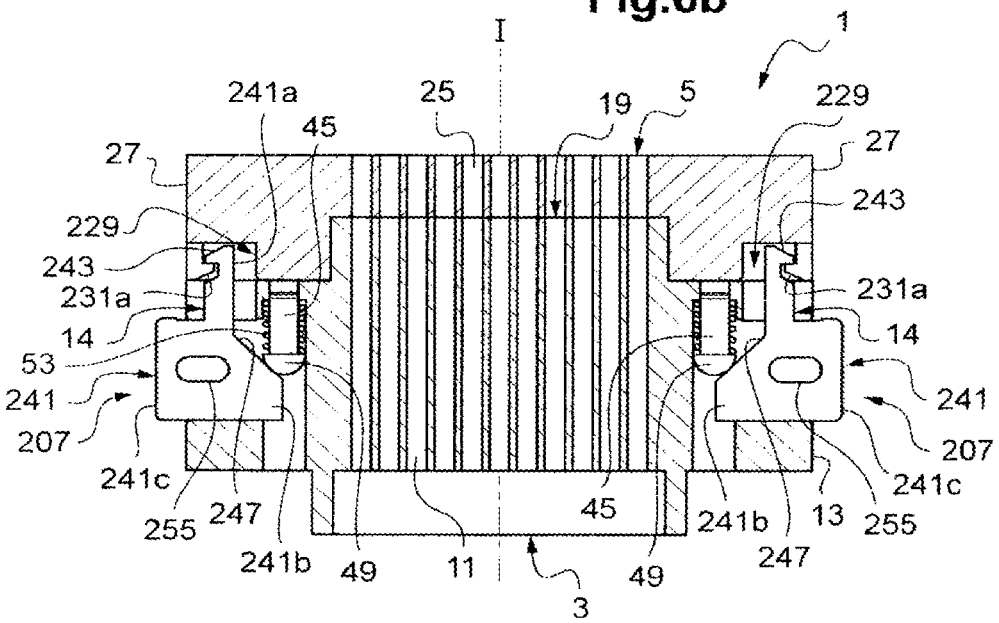
FIG. 6*b* is a cross-sectional view of the connector assembly of FIG. 6*a* according to the third embodiment representing the two connectors in the assembled state.
Figure 6C:
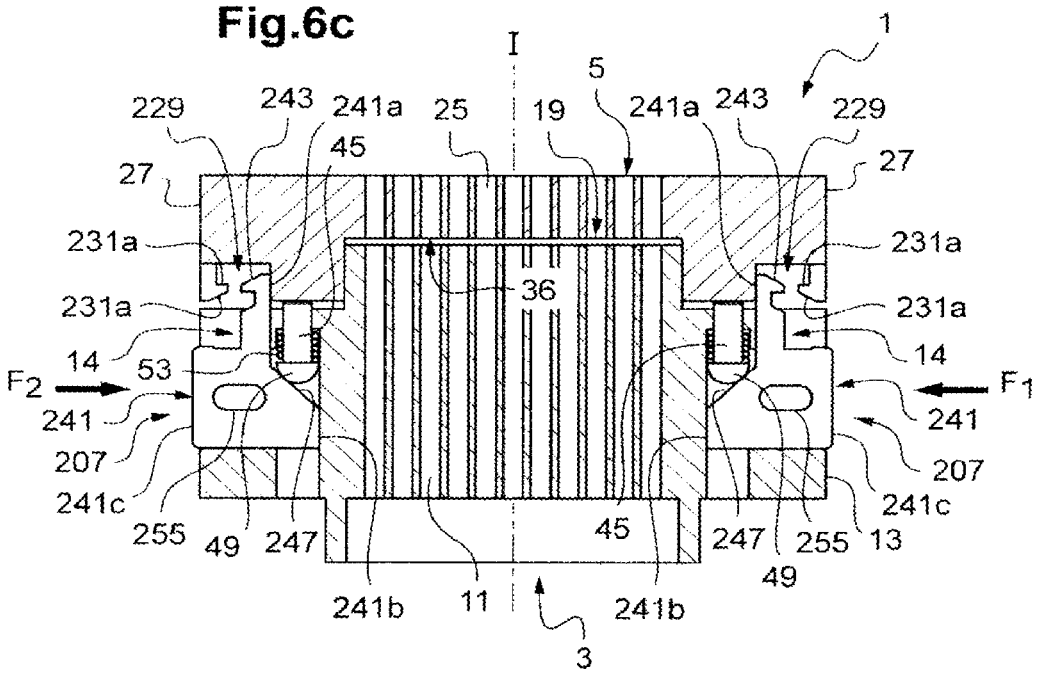
FIG. 6*c* is a cross-sectional view of the connector assembly of FIGS. 6*a* and 6*b* in which the connection and disconnection mechanism is in the disconnected state.

Contrary to the first or second embodiment, the actuation devices 241 according to the third embodiment illustrated in FIG. 6*a* are mounted to move translationally between a connection position illustrated in FIG. 6*b* and a disconnection position illustrated in FIG. 6*c*.

More specifically, referring to the orientation of FIGS. 6*b* and 6*c*, a first actuation device 241 on the right can move from the connection position to the disconnection position according to the arrow $F_1$ and a second actuation device 241 on the left can move from the connection position to the disconnection position according to the arrow $F_2$. The two actuation devices 241 slide toward the interior of the connector 3 from the connection position to the disconnection position.

The actuation devices 241 are produced at least partly in an elastically deformable material.

In a manner similar to the first embodiment and to the second embodiment, the actuation devices 241 respectively comprise:

- at least one first part 241*a* bearing for example a second securing means 243 and capable of being received in the complementary connector, such as the male connector 5 in this example,
- at least one second part 241*b* capable of cooperating with an associated ejection device 45.

As for the first and second embodiments, the actuation devices 241 advantageously comprise at least one third gripping part 241*c* accessible from the outside of said connector 3.

The three parts 241*a*, 241*b*, 241*c* of an actuation lever 241 are, according to the third embodiment illustrated in FIGS. 6*a* to 6*c*, produced in a single piece.

Moreover, the first part 241*a* and the third part 241*c* have a substantially "L" shaped form, the first part 241*a* extending substantially parallel to the plugging-in axis I and the third part 421*c* extending substantially transversely to the plugging-in axis I toward the exterior of the shell 9 of the associated connector, of the female connector 3 in the example illustrated. The third part 241*c* thus protrudes from the shell 9 of the connector 3.

The second part 241*b* is similar to the second part 41*b* described with reference to the first embodiment and is not therefore described again.

The third embodiment differs also from the first or second embodiment in that the fixing axis 15 no longer serves as pivoting axis for the first part 241*a*.

Furthermore, the hook 243 borne by the first part 241*a* according to the third embodiment as illustrated in FIGS. 6*a* to 6*c* differs from the first or second embodiment in that it is, for example, formed on the side of the first part 241*a* of the actuation device oriented toward the outside of the female connector 3.

According to an alternative illustrated in FIG. 7, the actuation lever 241 is for example produced in two parts:

- on the one hand the first part 241*a* bearing the second securing means 243, and capable of being received in the complementary male connector 5, and
- on the other hand, the second part 241*b* capable of cooperating with an associated ejection device 45 and the third gripping part 241*c* accessible from the outside of said connector 3. The second and third parts 241*b* and 241*c* are, according to this alternative, produced in a single piece.

According to this alternative, the first part 241*a* is advantageously mounted to move pivotably about a pivoting axis 244 on the third part 241*c* of the actuation lever 241. By way of example, the first part 241*a* is mounted on a spring 246 advantageously to allow the first part 241*a* to move between:

- a first position of rest in which the first part 241*a* is substantially parallel to the plugging-in axis I and
- a second position (represented by dotted lines in FIG. 7) in which the first part 241*a* is inclined relative to the plugging-in axis I.

This makes it possible to facilitate the snap-fitting between the first and second securing means 231 and 243 borne by the two connectors 3 and 5, when the two connectors 3 and 5 are plugged in.

Moreover, the actuation device 241 that is translationally mobile according to the third embodiment and produced in a single piece according to the variant of FIGS. 6*a* to 6*c* or in two pieces according to the variant represented in FIG. 7 can comprise an anti-rotation means 255. The anti-rotation means 255 makes it possible to work only in the axis of translation of the actuation device 241.

It is also possible to provide a stop making it possible to limit the travel of the actuation device 241. According to the example illustrated, the anti-rotation means 255 also ensures the stop function in the position of rest or in the position of maximum translation of the actuation device 241.

By way of illustrative and nonlimiting example, the anti-rotation means 255 is for example produced in a substantially oblong form.

It is also possible to provide for the anti-rotation means 255 to be capable of receiving a fixing means such as a pin (not visible in the figures) mounted on both sides of the shell 9.

Ejection Device

The ejection device 45 is distinct from the associated actuation device 41 or 141 or 241. More specifically, the ejection device 45 and the associated actuation device 41, 141, 241 are produced by two separate pieces.

The ejection devices 45, for their part, are mounted to move translationally in the plugging-in direction I of the female and male connectors 3, 5, between a position of rest and an ejection position in which they are capable of exerting a force on the facing complementary connector 5 so as to uncouple the connector assembly.

According to the embodiment described, in the rest position, an ejection device 45 is retracted inside the connector, for example the female connector 3. The surface of the ejection device 45 is then situated below, or is flush with, the surface of the associated connector, of the female connector 3 in the example described.

In the ejection position, the ejection device 45 protrudes from the surface of the associated connector, of the female connector 3 in the example described.

In the example illustrated in FIG. 3*b* or 5*b*, one of the ejection devices 45 (on the left in the figures) is illustrated in the rest position while the other ejection device 45 (on the right in the figures) is illustrated in the ejection position.

The ejection devices 45 are for example produced in the form of pieces or plungers 45.

The pieces 45 are, by way of example, produced in a material capable of absorbing the impact, by way of example in stainless material, which is for example passivated, or, as a variant, in plastic material to avoid damaging the shell 23 of the complementary connector 5 on which the pieces 45 are intended to apply a force. As a variant, or in addition, protection means can be provided, for example produced in the form of complementary pieces, provided on the complementary connector 5, at the level of the impact with the ejection devices 45.

The pieces 45 can have a head 49 capable of sliding over the corresponding contact surface 47, 147, 247 and a body 51 capable of pushing on the complementary connector, such as the male connector 5, when it is protruding in the ejection position. The body 51 extends along the plugging-in axis I of the two connectors 3 and 5, so as to allow a disconnection of the connectors 3 and 5, in the same direction as for the connection and the plugging-in of the two connectors 3, 5. The head 49 and the body 51 of a piece 45 can be produced in a single piece.

It is also possible to provide a means 53 for returning each ejection device 45 into the rest position. It is for example a return spring 53 such as a compression spring. Only one return spring 53 is illustrated in FIGS. 3*b* and 5*b*. The force exerted by an actuation device 41 to disconnect the two connectors 3, 5 must be greater than the return constant of the spring 53. The spring 53 is arranged such that the axis of the spring 53 is substantially parallel to the plugging-in axis I of the female and male connectors 3, 5.

Connection Method

First and Second Embodiments

The method for connecting the male and female connectors 5, 3 as described previously is performed as follows with reference to FIGS. 8*a* to 8*c* and 1.

Figure 8A:
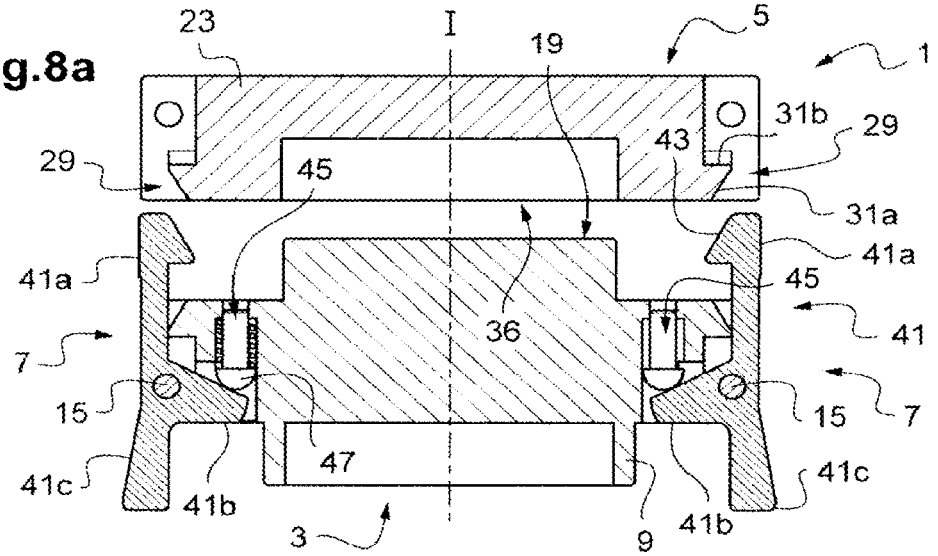
FIGS. 8*a* to 8*c* represent different steps of a sequence of connection of the two male and female connectors of the connector assembly of FIG. 1, and FIGS. 9*a* and 9*b* represent different steps of a sequence of connection of the two male and female connectors of the connector assembly of FIG. 6*a*.
Figure 8B:
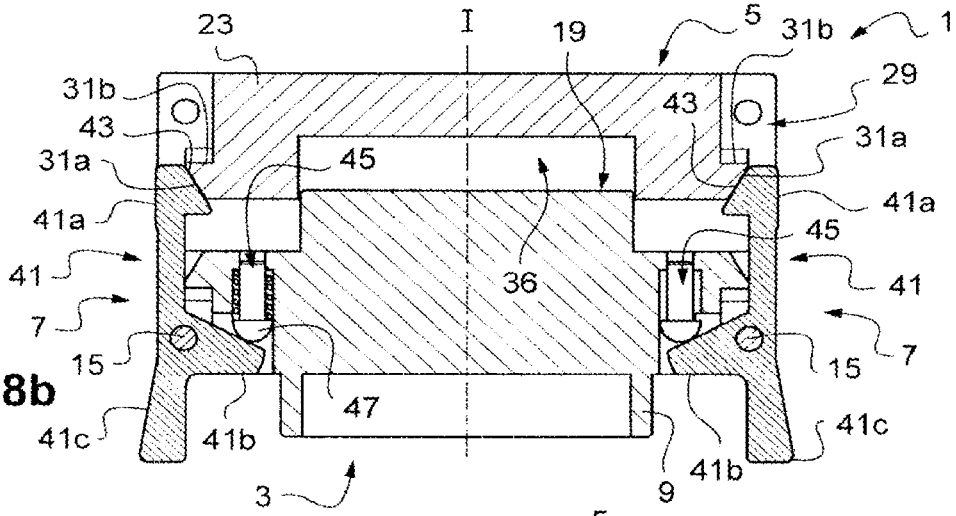
Figure 8C:
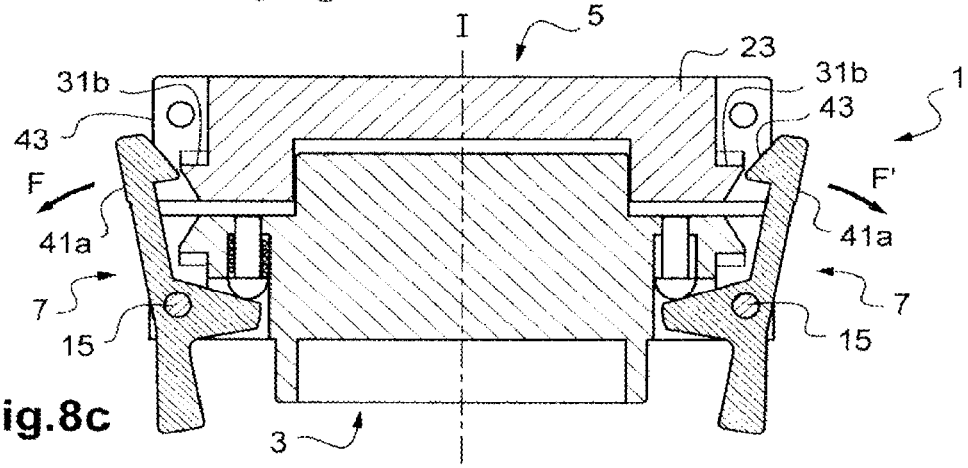

FIGS. 8*a* to 8*c* represent a sequence of connection of the connectors 3 and 5, one of which bears a connection and disconnection mechanism 7 according to the first embodiment. Obviously, the connection sequence is similar for a connection and disconnection mechanism 107 according to the second embodiment.

Thus, in order to mechanically and electrically connect the two disassembled female and male connectors 3, 5 as illustrated in FIG. 8*a*, in a first step, the two connectors 3 and 5 are positioned facing one another. More specifically, the supports for electrical contacts 19 and 35 respectively of the female connector 3 and of the male connector 5 are placed facing one another.

The two connectors 3, 5 are plugged in the plugging-in direction I, such that the actuation devices 41 or 141 borne by one connector 3 are inserted at least partially into the corresponding housings on the other connector 5, and come to be fixed in the other connector 5.

More specifically, the first parts 41*a* (or 141*a*) of the actuation devices 41 (or 141) borne by one connector, such as the female connector 3, are inserted into the housings 29, for example produced by recesses 29, provided on the other connector, such as the male connector 5. This is schematically represented in FIG. 8*b*.

The plugging in of the two connectors 3, 5 along the axis I drives the securing hook 43 (or 143) provided at the end of each actuation device 41 (or 141) to slide over the slope 31*a* of the first securing means 31 of the complementary connector, here the male connector 5, such that each actuation device 41 (or 141) pivots slightly outward from the connector 3 as schematically represented in FIG. 8*c* by the arrows F and F', without however pivoting sufficiently to drive the ejection devices such as pieces 45 in translation, to a position protruding from the shell 9 of the female connector 3.

By continuing to plug in the two connectors 3 and 5 along the axis I, the hooks 43 (or 143) go beyond the slope 31*a* and come to bear against the corresponding bearing portions 31*b* provided on the complementary connector, such as the male connector 5, as schematically represented by FIG. 1.

The two connectors 3 and 5 are thus kept connected by virtue of the snap-fitting of the actuation devices 41 (or 141) borne by one connector, such as the female connector 3, on the other complementary connector, such as the male connector 5.

In this plugged-in position of the two connectors 3 and 5, the second electrical contacts 39 (see FIG. 2) borne by the male connector 5 are received in the first complementary electrical contacts 22 borne by the female connector 3.

It is possible to provide an additional step of capping of the connector assembly 1 making it possible to avoid an untimely actuation of the connection and disconnection mechanism 7 (or 107 or 207).

Third Embodiment

Figure 9A:
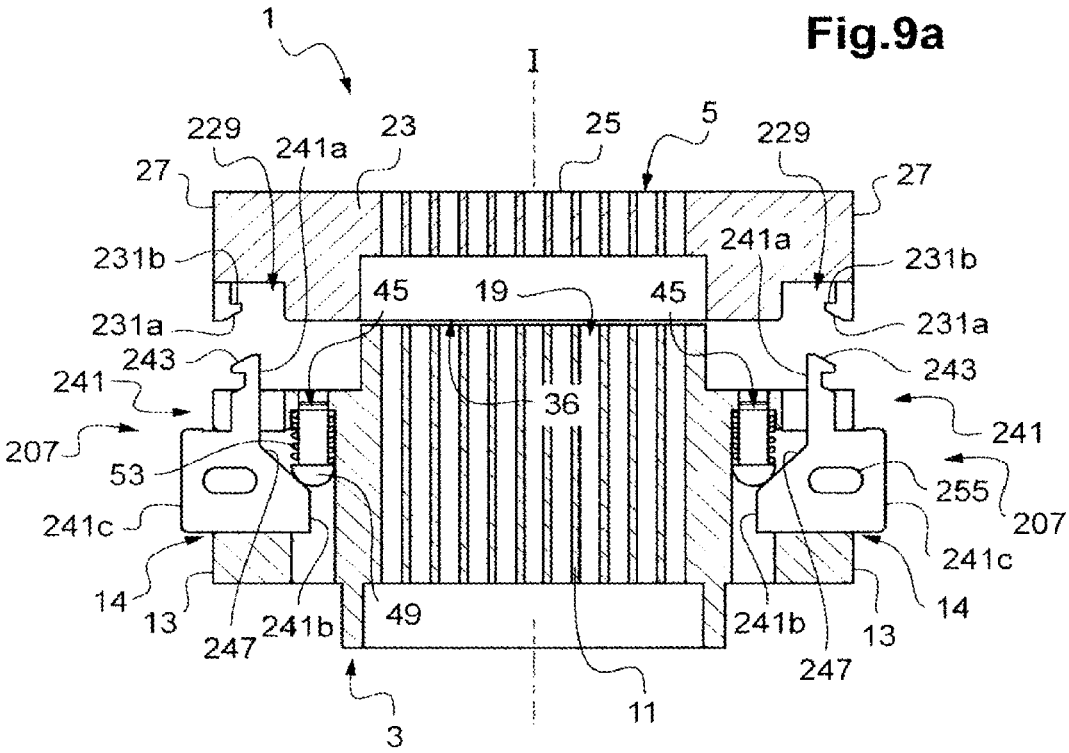
Figure 9B:
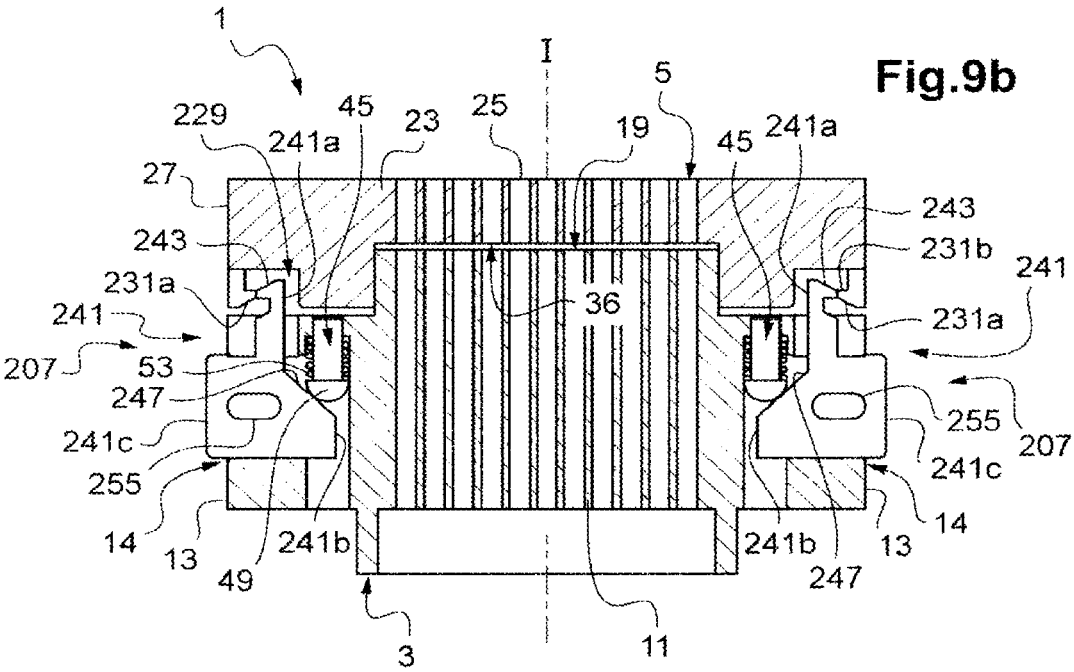

Referring to FIGS. 9*a* and 9*b*, the method for connecting the connectors 3 and 5, one of which bears a connection and disconnection mechanism 207 according to the third embodiment differs in that the first parts 241*a* of the actuation devices 241 borne by one connector, such as the female connector 3, are inserted into the housings 229 produced inside the complementary connector, such as the male connector 5.

Starting from the disassembled position of the two connectors 3 and 5 illustrated in FIG. 9*a*, the plugging-in of the two connectors 3, 5 along the axis I drives the securing hook 243 provided at the end of each actuation device 241 to slide over the slope 231*a* of the first securing means 231 of the complementary connector, here the male connector 5. This sliding results in a translational displacement of the actuation levers 241 toward the interior of the connector, here the female connector 3, such that the ejection device 45 is also driven to slide over the substantially inclined contact surface 247 of the third part 241*c* of each actuation lever 241, without however being driven to a position protruding from the shell 9 of the female connector 3.

By continuing the plugging-in of the two connectors 3 and 5 along the axis I, the hooks 243 are located against the associated first securing means 231 of the complementary connector, here the male connector 5, as illustrated in FIG. 9*b*, to go beyond respectively the corresponding slope 231*a* and come to bear against the bearing portions 231*b* of the complementary first securing means 231, as schematically represented by FIG. 6*b*.

In addition or as an alternative, it is possible to produce the actuation device 241 at least partially in an elastically deformable material, in particular at the level of the second securing means 243.

According to another alternative of the actuation device 241 in two parts, represented schematically in FIG. 7, upon the plugging-in of the two connectors 3, 5 along the axis I, the sliding of the securing hook 243 against the slope 231*a* of the first securing means 231 of the complementary connector, here the male connector 5, drives the pivoting of the first part 241*a* of the actuation lever 241 toward the interior of the connector, here the female connector 3, before coming to bear against the bearing portions 231*b* of the complementary first securing means 231 of the male connector 5.

Disconnection Method

First and Second Embodiments

Regarding the first or the second embodiment, in order to disconnect the two plugged-in connectors 3 and 5 as represented in FIG. 1, at least one actuation device 41, 141 borne by one of the connectors, the female connector 3 in the examples illustrated, is pivoted toward the disconnection position, such that the associated ejection device 45 is driven in translation along the plugging-in axis I toward the other complementary connector 5, so as to push on the facing complementary connector 5 to uncouple the two connectors 3, 5.

According to the embodiments illustrated, the two actuation devices 41 (FIG. 3*b*) or 141 (FIG. 5*b*) on either side of the associated connector bearing them, such as the female connector 3, are for example pivoted manually.

Upon the pivoting of the actuation device 41 or 141 toward the disconnection position, the associated ejection device, such as a piece 45, is driven in translation along the plugging-in axis I by the actuation device 41 or 141. More specifically, the ejection device 45, for example the head 49 of the piece 45, slides over the contact surface 47 or 147 of the associated actuation device 41 or 141 and the ejection device 45, for example the body 51 of the piece 45, is displaced in translation along the plugging-in axis I toward the other complementary connector, such as the male connector 5 (upward with reference to the orientation of FIG. 3*b* or 5*b*).

The ejection devices 45, more specifically the bodies of the pieces 45 in this example, are located protruding from the plane defined by the connector 3 bearing the connection and disconnection mechanism 7 or 107, so as to push on the facing complementary connector 5 and thus provoke the separation of the electrical contacts 22, 39 of the male connector 5 and of the female connector 3.

Third Embodiment

The method for disconnecting the connectors 3 and 5, one of which bears a connection and disconnection mechanism 207 according to the third embodiment differs in that, to disconnect the two plugged-in connectors 3 and 5 as represented in FIG. 6*b*, the actuation devices 41, 141 are no longer pivoted but, on the contrary, the actuation devices 241 are pushed according to the arrows $F_1$ and $F_2$ on either side of the connector 3 toward the disconnection position, namely toward the interior of the female connector 3, as schematically represented in FIG. 6*c*.

In a manner similar to the first or second embodiment, the associated ejection device 45, more specifically the head 49, then slides over the contact surface 247 of the associated actuation device 241 and the ejection device 45, for example the body 51 of the piece 45, is displaced in translation along the plugging-in axis I toward the other complementary connector, such as the male connector 5 (upward with reference to the orientation of FIG. 6*c*). The ejection device 45 then pushes on the facing complementary connector 5 which makes it possible to uncouple the two connectors 3, 5.

Thus, it will therefore be understood that with such a connection and disconnection mechanism 7, 107 or 207, for connecting (or coupling) the two connectors 3 and 5, the actuation devices 41, 141, 241 come to be fixed, for example by snap-fitting, in a simple manner to the complementary connector 5. No particular manipulation is required. Furthermore, return springs 53 can make it possible for the actuation devices 41, 141 to remain in the locked rest position.

Regarding the uncoupling or disconnection of the two connectors 3 and 5, it is sufficient to exert a pressure on the gripping parts 41*c*, 241*c* according to the first and third embodiments, or a rotational movement of the thumbwheels 141*c* according to the second embodiment, to drive the two pieces 45, so as to push on the facing connector and uncouple the connection.

In conclusion, the connection and disconnection mechanism 7, 107, 207 according to the invention makes it possible to couple and uncouple the two connectors 3 and 5 in total safety, with no tools and blind. In effect, the simplicity of the connection and disconnection mechanism 7, 107, 207 and the absence of the need for specific tools makes it possible to disconnect the two connectors 3 and 5 without even seeing them.

Furthermore, that makes it possible to uncouple the two connectors 3 and 5 in the plugging-in direction I, in the alignment of the connection spindles without damaging them, with no random movements and without pulling on the cables.

The connector assembly 1 is therefore ergonomic and easy to use, with intuitive connection or disconnection.

The invention claimed is:

1. A connector that is connectable to a complementary connector on a plugging-in axis to produce an electrical connection by a mechanism for connecting to and disconnecting from the complementary connector, the connector comprising:

an actuation device mounted to move on said connector between a connection position and a disconnection position, the actuation device comprising a first part configured to cooperate with the complementary connector to fix the connector to the complementary connector in the connection position; and an ejection device translationally mobile along the plugging-in axis into a position protruding toward the complementary connector, the actuation device comprising a second part configured to cooperate in the disconnection position with the ejection device to drive a linear displacement of the ejection device along the plugging-in axis into the protruding position, the actuation device and the ejection device being formed by at least two separate pieces of the connector.

2. The connector as claimed in claim 1, wherein the actuation device is pivotably mounted.

3. The connector as claimed in claim 2, wherein the actuation device is fixed to said connector using an axis arranged in such a way as to pass transversely through said connector and the actuation device, and wherein the actuation device is pivotably mobile about said axis.

4. The connector as claimed in claim 1, wherein the actuation device is mounted to be translationally and linearly mobile substantially transversely to the plugging-in axis.

5. The connector as claimed in claim 1, wherein the ejection device is mounted on said connector between a position retracted inside said connector and a position protruding from said connector toward the complementary connector.

6. The connector as claimed in claim 1, wherein the connection and disconnection mechanism comprises two of the actuation devices and two ejection devices each respectively associated with one of the actuation devices.

7. The connector as claimed in claim 6, wherein said connector extends longitudinally through a first and a second end lateral walls, and the two actuation devices are arranged on the two longitudinally opposing end lateral walls of said connector.

8. The connector as claimed in claim 1, wherein the first part of the actuation device has a means for securing to the complementary connector, produced in the form of a hook.

9. The connector as claimed in claim 1, wherein the second part has a contact surface inclined relative to the plugging-in axis.

10. The connector as claimed in claim 1, wherein the actuation device comprises a gripping part accessible from outside said connector.

11. The connector as claimed claim 10, wherein the gripping part is arranged at an end of the actuation device opposite an end bearing the first part configured to cooperate with the complementary connector.

12. The connector as claimed in claim 10, wherein the actuation device comprises a thumbwheel having the gripping part accessible from outside said connector and a part formed inside said connector to cooperate with an associated ejection device.

13. A connector assembly comprising:

a female connector; and a male connector complementing the female connector, wherein at least one of the male and female connectors conforms to the connector recited in claim 1.

14. The connector assembly as claimed in claim 13, wherein the other one of the male and female connectors complementing the connector bearing the connection and disconnection mechanism has at least one housing configured to engage with and secure at least one element of the connection and disconnection mechanism.

* * * * *